United States Patent [19]

Hubalek et al.

[11] 4,251,099

[45] Feb. 17, 1981

[54] AUTOMATIC RELEASE DEVICE FOR LIFTING SLINGS

[75] Inventors: Jan Hubálek; Vladimír Doksanský; Jan Michal, all of Prague, Czechoslovakia

[73] Assignee: Institut manipulacnich, dopravnich, obalovych a skladovacich systemu, Prague, Czechoslovakia

[21] Appl. No.: 53,955

[22] Filed: Jul. 2, 1979

[30] Foreign Application Priority Data

Jun. 30, 1978 [CS] Czechoslovakia ..... 4376-78

[51] Int. Cl.[3] ..... B66C 1/38

[52] U.S. Cl. ..... 294/75; 294/83 R

[58] Field of Search ..... 294/74–76, 294/78 R, 81 R, 83 R, 83 A, 84

[56] References Cited

U.S. PATENT DOCUMENTS

| | | | |
|---|---|---|---|
| 1,005,615 | 10/1911 | Doose | 294/84 |
| 2,490,558 | 12/1949 | Sullivan | 294/83 A |
| 2,829,916 | 4/1958 | Morales | 294/75 |
| 3,079,193 | 2/1963 | Brewer | 294/75 |
| 3,175,798 | 3/1965 | Lewis | 294/83 R X |

FOREIGN PATENT DOCUMENTS

| | | | |
|---|---|---|---|
| 2539513 | 3/1977 | Fed. Rep. of Germany | 294/83 R |
| 110157 | 6/1925 | Switzerland | 294/83 R |

*Primary Examiner*—Johnny D. Cherry

[57] ABSTRACT

An automatic sling release serving for the automatic disengagement of a sling, such as a chain, a rope, or a strap from a hoisting hook at the moment of relieving the sling of the weight of the load. The device has a load sustaining body with a first, sling engaging hook thereon. A releasing arm is pivotally mounted on the body, the releasing arm having a portion thereof in the form of a second hook positioned close to the first hook and partially overlapping it. The second hook has two working faces, i.e., an upper sling end engaging face and a front thrusting face, in the basic unloaded position of the releasing arm the front thrusting face projecting beyond the outer edge of the first hook on the load sustaining body. The application of a sling end to the upper face of the releasing arm and the subjection of the device to a load results in the swinging of the releasing arm to its loaded position wherein it partially clears the first hook and the transfer of the sling end from the upper face of the releasing arm to the first hook. Upon the release of the pull of the load upon the body, the releasing arm swings so that its front thrusting face pushes the sling end off the first hook.

5 Claims, 3 Drawing Figures

AUTOMATIC RELEASE DEVICE FOR LIFTING SLINGS

The invention relates to an automatic release device for the end of a lifting sling. The release device serves for an automatic disengagement of the sling from the notch of a hoisting hook at the moment that the sling has been relieved of the weight of the load.

According to current practice, slings are attached to a crane hook and are released manually. Accidents often occur at the very moment of releasing the load on the hook when the sling attendant is stationed close to the swinging load or near to a load which is in unstable position. That being the case, various systems of sling release devices have been designed which are capable of releasing the sling without the direct help of an attendant. The operation of existing sling release devices, however, is based on hydraulic, pneumo-electric or electromagnetic principles, and requires a supply of power from an extraneous source. Such an arrangement needs a special control system between the sling and the crane operator. This is a relatively costly and exacting arrangement and therefore it is seldom used in current practice.

The above-mentioned disadvantages are eliminated by the automatic sling release device of the present invention, which serves for the automatic disengagement of chain slings, sling ropes or straps from a crane hook at the moment when the slings have been relieved of the weight of the load hanging on a lifting beam or a crane hook.

The sling release device of the invention essentially comprises a fixed releasing body and at least one releasing arm pivotally mounted thereon, the pivotable releasing arm having two working faces, i.e. an upper retaining face and a front thrusting face. The portion of the releasing bearing such two working faces is positioned close to and partially overlaps the notch of a hook on the body of the device. In the basic unloaded position of the device, the thrusting face of the pivotable releasing arm projects beyond the outer edge of the fixed hook on the body, which may be fitted with catches or the like for hanging onto a crane hook. It can also be made in the form of a yoke straddling the lifting beam which in turn is lifted by a crane, the releasing arm being pivotally attached to the yoke. A sling is associated with the releasing body, one end of the sling being permanently attached thereto, and the other end of the sling being adapted to be automatically released from the notch of a hook on the body of the device.

The sling release device according to the present invention operates in a fully automatic and a safe manner. It requires neither a separate power source for releasing the sling nor any accessory control system. The sling releasing action follows automatically after the load has been laid down, the sling thereby being relieved of the weight of the load, so that the crane operator himself controls the operation of the device. The sling release device can be installed as an accessory to existing cranes. The sling release action can take place only after the load has been laid down upon a load sustaining device, such as a floor, a platform, or the like.

An exemplary embodiment of the device of the invention is shown in the accompanying drawings, in which.

Figure 1:
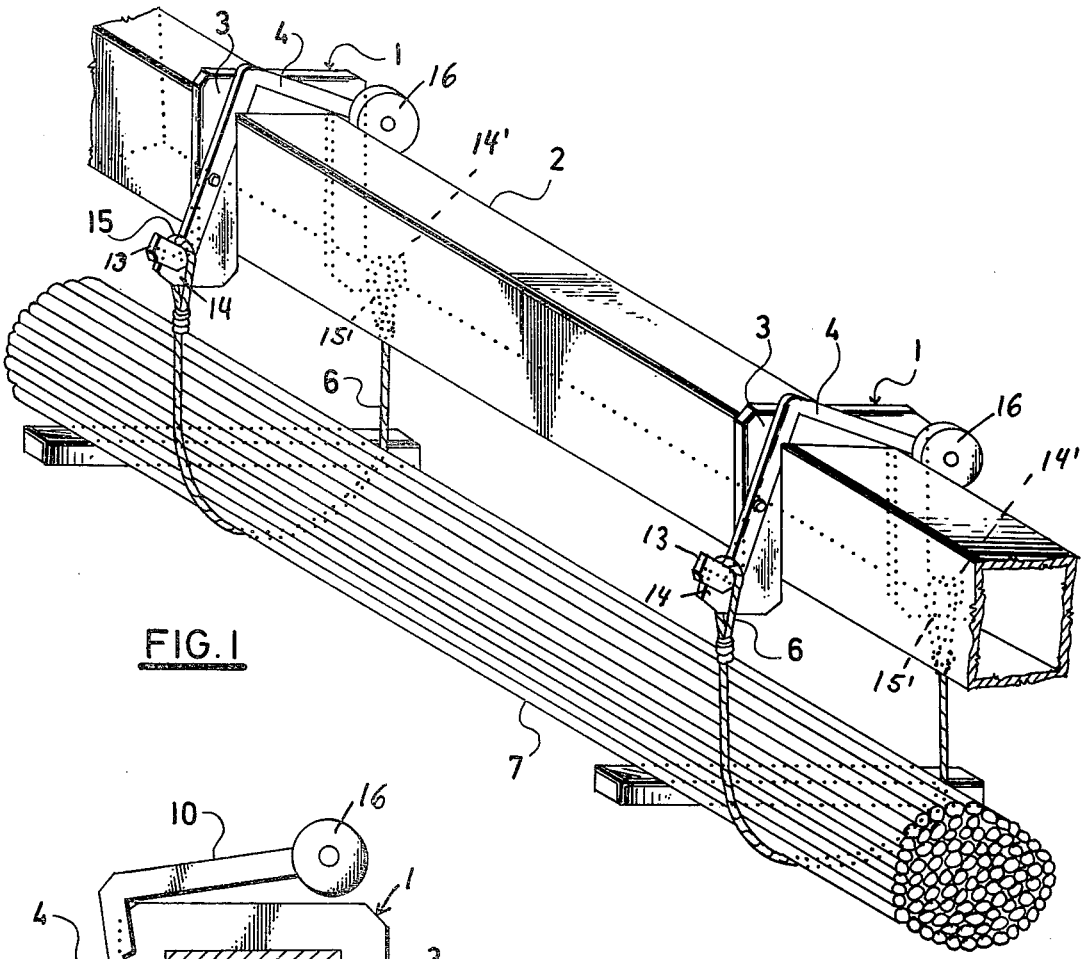
FIG. 1 is a view in perspective of an overall arrangement of two automatic sling release devices in accordance with the invention on a crane lifting beam.

In the embodiment shown, the automatic sling release device 1 has a body 3 shaped as a yoke which straddles a lifting beam 2. Such beam 2 may be attached to the lifting means of a crane (not shown). Alternatively, in accordance with an unillustrated embodiment, the yoke itself may be provided with means such as a hook or an eye for direct attachment to a crane.

The device 1 comprises two parts, i.e. the yoke 3 functioning as a fixed releasing body and a releasing arm 4 pivotally mounted upon body 3. On the lower ends of the legs of the fixed releasing body 3, there are provided retaining hooks or notches 14, 14' for the suspension of a sling 6 encompassing a load 7. The end of the sling 6 shown at the right has an eye or loop 15' at the end thereof which is fixedly secured to the hook 14'. The other end of the sling 6 is provided with a similar eye or loop 15 which is disengagably connected with a hook 14 on the lower end of the left-hand leg of the yoke. As shown, the sling 6 encompasses a load 7.

A releasing arm 4 is pivotally connected to the left hand of yoke 3 by a pivot pin 8, the releasing arm 4 being in the form of a two-armed or bell crank lever having a generally vertical arm and an upper generally horizontal arm 10 to the outer end of which there is affixed a weight 16. The lower end of the vertical arm of releasing arm 4 has an auxiliary hook or notch 9 which serves as a temporary support for the eye or loop 15 on the sling 6 when loop 15 is first mounted upon the yoke 3, and for the disengagement of the loop 15 from the hook 14 when a load 7 hoisted by the sling 6 is laid down.

Figure 3:
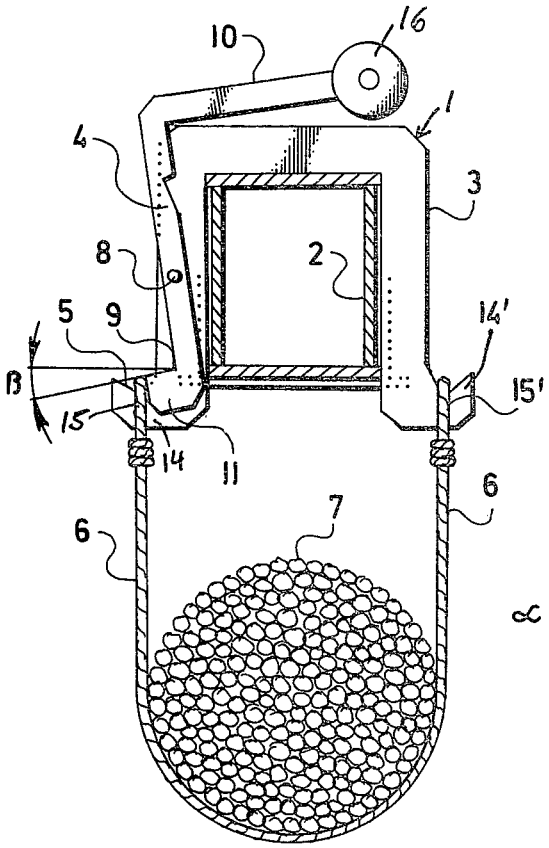
FIG. 3 is a view in side elevation of the automatic sling release device of FIG. 2 bearing a load and with the releasing arm thereof in its loaded position.
Figure 2:
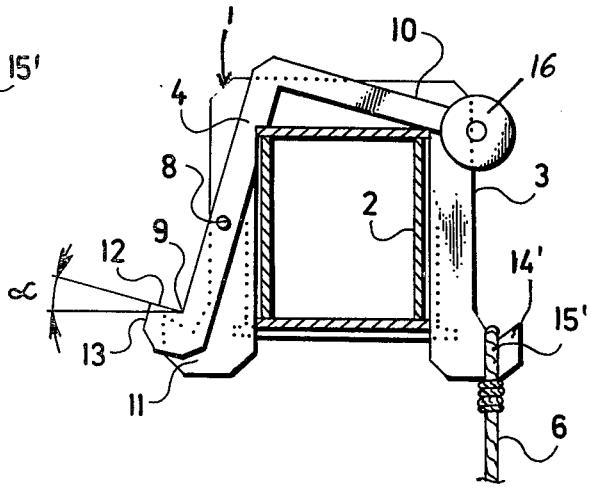
FIG. 2 is a fragmentary view in side elevation of an automatic sling release device in accordance with FIG. 1, with the releasing arm thereof in its basic unloaded position.

The lower end of the substantially vertical arm of the two-armed lever 4 lies close to and partially overlaps the hook 14 on the yoke 3. Such lower end of the generally vertical arm of the two-armed lever 4 is provided with an auxiliary notch 9, an upper retaining face 12, and a thrusting face 13. In the unloaded condition of the device 1, shown in FIG. 2, the lever 4 is rotated by the weight 16 into its clockwise terminal position in which the upper retaining face on the lower end of such lever is inclined to the horizontal so as to form a positive angle $\alpha$ therewith. On the other hand, in the loaded position of the device 1, as shown in FIG. 3, the upper retaining face 12 is inclined at a negative angle $\beta$ with respect to the horizontal. In the FIG. 2 position of the lever 4 the lower end thereof completely overlaps the upper active portion of the hook 14, whereas in the FIG. 3 position thereof the upper slanting surface 5 of the hook 14 is uncovered at the outer end thereof so as to receive the loop 15 of the sling 6 thereupon. In such latter position, loop 15 abuts the thrusting surface 13 of the releasing lever 4.

The device 1 of the invention operates as follows:

The lifting beam 2 is lowered toward a load 7 which rests upon means such as timbers as shown in FIG. 1, so that the then-free ends of the slings 6 may be passed thereunder and the loops 15 thereon mounted upon the upper retaining surfaces 12 of the levers 4 of the respective devices 1. Thereafter, the crane lifts the beam 2 to subject the slings 6 to tension and to raise load 7. This causes the loops 15 of the sling to rotate the releasing arms 4 counterclockwise into their FIG. 3 position. Because the upper retaining surface 12 of each of the arms 4 then is disposed at the negative angle $\beta$ with respect to the horizontal, the loops 15 slide down their respective surfaces 12 to assume the position thereof shown in FIG. 3, wherein such loops are supported upon the upper surface 5 of the hooks 14 and abut the thrusting surfaces 13 on the levers 4.

Upon the release of tension in the sling 6 at the moment of deposition of load 7 upon a supporting means, the front thrusting face 13 of the pivotable releasing arms 4 of the devices 1 dislodge the loops 15 of the slings 6 by sidewise pressure upon the loops of the surfaces 13 on the arms 4 to release such loops from the retaining notches 5, such action being caused by the rotation of the arms 4 to their terminal clockwise position by the weights 16. Upon disengagement of the loops or eyes 15 of the slings 6 from the surfaces 5 of the hooks 14, the loops 15 of the slings fall off the hooks 14 and by hoisting the lifting beam 2 the slings 6 can be removed from beneath the load 7. As above noted, the loops 15', on the left-hand end of the slings, remain attached to the hooks 14' on the right-hand leg of the yoke 3, to which they are permanently secured.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. An automatic sling release device which cooperates with a load supporting sling, comprising a load sustaining body, a first, sling engaging hook on the body, a sling releasing member movably mounted on the body, the releasing member having a portion thereof in the form of a second hook positioned close to the first hook and partially overlapping it, the second hook having an upper sling end-engaging face and a front thrusting face, in the basic unloaded position of the releasing member the front thrusting face projecting beyond the outer edge of the first hook on the load sustaining body, and yieldable means for constantly urging the releasing member toward its unloaded position whereby the second hook thrusts a sling end off the first hook when the load sustaining body is relieved of the pull of a load.

2. The device according to claim 1, wherein the releasing member is a lever pivotally mounted on the body.

3. The device according to claim 1, wherein the releasing member is in the form of a bell crank lever having a generally vertical arm and a generally horizontal arm, the generally vertical arm bearing the said upper and front faces, and wherein the yieldable means is a weight on the generally horizontal arm of the bell crank lever.

4. The device according to claim 1, wherein the load sustaining body is in the form of a yoke having two depending legs spaced from each other, the yoke being adapted to straddle a crane lifted beam.

5. The device according to claim 4, wherein the sling is permanently attached at one end to one leg of the yoke, and the other end of the sling is releasably secured to the other leg of the yoke by said automatic sling release device.

* * * * *